US008981877B2

(12) United States Patent
Baldwin

(10) Patent No.: US 8,981,877 B2
(45) Date of Patent: Mar. 17, 2015

(54) LOCKING DEVICE FOR A RADIO FREQUENCY FILTER TUNING PROBE

(75) Inventor: Francis Baldwin, Naples, ME (US)

(73) Assignee: Dielectric, LLC, Raymond, ME (US)

( * ) Notice: Subject to any disclaimer, the term of this patent is extended or adjusted under 35 U.S.C. 154(b) by 274 days.

(21) Appl. No.: 13/552,977

(22) Filed: Jul. 19, 2012

(65) Prior Publication Data

US 2013/0021117 A1 Jan. 24, 2013

Related U.S. Application Data

(60) Provisional application No. 61/509,520, filed on Jul. 19, 2011.

(51) Int. Cl.

| | |
|---|---|
| ***H01P 1/202*** | (2006.01) |
| ***H01P 1/208*** | (2006.01) |
| ***H01P 7/04*** | (2006.01) |
| ***H01P 7/06*** | (2006.01) |
| ***H01P 1/207*** | (2006.01) |

(52) U.S. Cl.

CPC *H01P 1/207* (2013.01); *H01P 7/04* (2013.01); *H01P 7/06* (2013.01); *H01P 1/202* (2013.01); *H01P 1/208* (2013.01)

USPC ..... 333/202; 333/207; 333/226; 333/232

(58) Field of Classification Search

CPC ..... H01P 1/208; H01P 1/2133; H01P 1/2053; H01P 7/04; H01P 7/06

USPC ..... 333/207, 202, 224, 226, 231–233

See application file for complete search history.

(56) References Cited

U.S. PATENT DOCUMENTS

| | | | | |
|---|---|---|---|---|
| 4,001,737 | A * | 1/1977 | Scott | 333/232 |
| 4,647,883 | A * | 3/1987 | Oxley | 333/245 |
| 6,384,699 | B1 * | 5/2002 | Henningsson et al. | 333/224 |
| 2004/0028501 | A1 * | 2/2004 | Haraldsson et al. | 411/437 |

* cited by examiner

*Primary Examiner* — Robert Pascal
*Assistant Examiner* — Gerald Stevens
(74) *Attorney, Agent, or Firm* — Baker Hostetler LLP

(57) ABSTRACT

A radio frequency (RF) filter includes an input port configured to receive a signal, an output port configured to output a signal, and a tuning probe configured to be movable within a tuning probe port to adjust filter characteristics. The tuning probe port is configured to receive the tuning probe therein, and a locking mechanism is configured to lock the tuning probe in the tuning probe port at a desired depth and further configured to prevent movement of the tuning probe in the tuning probe port when the locking mechanism is in a locked configuration.

16 Claims, 6 Drawing Sheets

LOCKING DEVICE FOR A RADIO FREQUENCY FILTER TUNING PROBE

BACKGROUND OF THE DISCLOSURE

1. Field of the Disclosure

The disclosure relates generally to a filter tuning probe for a radio frequency device. More particularly, the disclosure relates to a filter tuning probe for a radio frequency device having a locking device.

2. Related Art

With the increasing growth of wireless communications, the use of lower power radio frequency (RF) transmitters to fill in presently unserved areas is also increasing. Whether the application is broadcast TV, cellular phone service, wireless broadband access or many others, the availability of cost effective equipment for deployment of these lower power sites is critical. One of the key components for many of these sites will be the filter devices used on an output of the transmitters to maintain compliance with regulatory guidelines limiting the out-of-band signal levels that may cause interference to other channels.

One of the desired features for cost effective, low power filter design is the ability to use common components in multiple channel applications and for components in other various frequency applications. For example, using the same enclosure for the filter cavities over a wide band of frequencies such as the UHF TV band (470 MHz-860 MHz), VHF frequency bands, FM frequency bands, wireless frequency bands, GHz frequency bands, and the like. However, for each individual channel within that band, the optimum physical size is not constant. Therefore, some adjustment must be available to allow tuning of the cavities for each specific channel and application. Additionally, it is desirable that a filter have the capability of being retuned for a different channel if the application it is being used for changes in the future.

Typically, determination of the desired tuning probe penetration depth is an iterative process. Present state of the art utilizes flexible contact devices such as watchband springs and contact finger stock. These devices can be both costly and require machining of support grooves and/or attachment hardware to assemble. These approaches require the use of custom designed tubing or rod materials for the tuning probe that substantially adds to the cost.

Accordingly, there is a need for cost effective manufacturing of these filters while maintaining compliance to out-of-band emissions.

SUMMARY OF THE INVENTION

The foregoing needs are met, to a great extent, by the invention, with a filter that addresses the need for cost effective manufacturing while maintaining compliance to out-of-band emissions. In particular, the invention addresses one of the more costly assemblies associated with tuning of each filter cavity, i.e., the capacitive probe or resonator (tuning probe). Insertion of a tuning probe into a filter cavity changes the electrical characteristics of the filter cavity according to the amount of penetration into the cavity. This effect, of course, requires a repeatable electrical contact between the tuning probe and the cavity wall after multiple movements of the tuning probe. The invention advantageously allows the use of commonly found sizes of copper tubing or rod which significantly reduces the cost of assembly.

In one or more aspects, a radio frequency (RF) filter includes an input port configured to receive a signal, an output port configured to output a signal, a tuning probe configured to be movable within a tuning probe port to adjust filter characteristics, the tuning probe port is configured to receive the tuning probe therein, and a locking mechanism configured to lock the tuning probe in the tuning probe port at a desired depth and further configured to prevent movement of the tuning probe in the tuning probe port when the locking mechanism is in a locked configuration.

The locking mechanism may include a threaded portion, and wherein the tuning probe port comprises a threaded portion that cooperates with the locking mechanism threaded portion to provide the locked configuration. The locking mechanism further may include a slot in the threaded portion; and the threads may include tapered threads. The locking mechanism further may include a plurality of flat sides configured for engagement with a tool. The flat sides of the locking mechanism further may include a slot configured to allow an inner diameter of the locking mechanism to increase to provide an unlocked configuration or decrease to provide the locked configuration. The filter may further include at least one fixed resonator configured to be received in a filter resonator port. The tuning probe may include a hollow cylindrical body. The tuning probe may include an inner end cap, a centering sleeve, and an outer end cap. The radio frequency (RF) filter may include a connector configured to connect the inner end cap, the centering sleeve, and the outer end cap. A wireless communications system may include the radio frequency (RF) filter as noted above.

Another aspect of the invention, a radio frequency (RF) filter includes an input port configured to receive a signal, an output port configured to output a signal, a tuning probe configured to be movable within a tuning probe port to adjust filter characteristics, the tuning probe port is configured to receive the tuning probe therein, and a locking means for locking the tuning probe in the tuning probe port at a desired depth and further configured to prevent movement of the tuning probe in the tuning probe port when the locking means is in a locked configuration.

The locking means may include a threaded portion, and wherein the tuning probe port comprises a threaded portion that cooperates with the locking mechanism threaded portion to provide the locked configuration. The locking means may further include a slot in the threaded portion; and the threads may include tapered threads. The locking means may further include a plurality of flat sides configured for engagement with a tool. The flat sides of the locking means further may further include a slot configured to allow an inner diameter of the locking means to increase to provide an unlocked configuration or decrease to provide the locked configuration. The radio frequency (RF) filter may further include at least one fixed resonator configured to be received in a filter resonator port. The tuning probe may include a hollow cylindrical body. The tuning probe may include an inner end cap, a centering sleeve, and an outer end cap. The radio frequency (RF) filter may further include a connector configured to connect the inner end cap, the centering sleeve, and the outer end cap.

There has thus been outlined, rather broadly, certain aspects of the invention in order that the detailed description thereof herein may be better understood, and in order that the present contribution to the art may be better appreciated. There are, of course, additional aspects of the invention that will be described below and which will form the subject matter of the claims appended hereto.

In this respect, before explaining at least one aspect of the invention in detail, it is to be understood that the invention is not limited in its application to the details of construction and to the arrangements of the components set forth in the following description or illustrated in the drawings. The invention is capable of aspects in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the invention. It is important, therefore, that the claims be regarded as including such equivalent constructions insofar as they do not depart from the spirit and scope of the invention.

DETAILED DESCRIPTION

Figure 2:
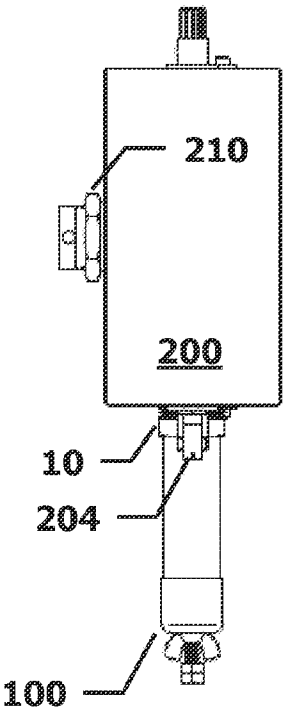
FIG. 2 is a left side view of the radio frequency filter of FIG. 1.
Figure 1:
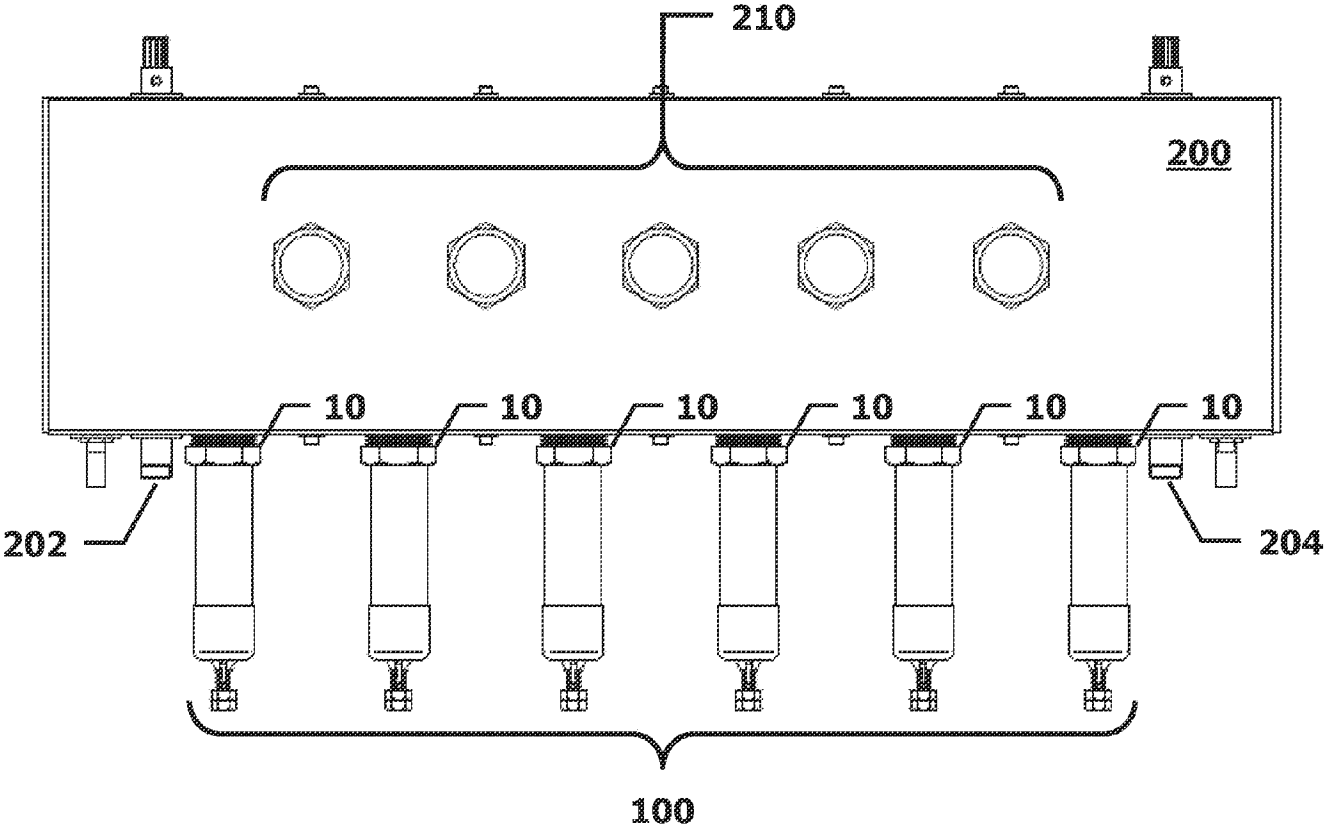
FIG. 1 is a top view of a radio frequency filter constructed according to an embodiment of the invention.

FIG. 1 is a top view of a radio frequency filter constructed according to an embodiment of the invention; and FIG. 2 is a left side view of the radio frequency filter of FIG. 1. In particular, FIGS. 1 and 2 present a top view and a left side view, respectively, of a radio frequency (RF) filter 200 according to an embodiment of the invention. Filter 200 may include, inter alia, an input port 202, an output port 204 and several tuning probe ports disposed along one side of the filter 200. In this embodiment, six tuning probes 100 are installed along a first side of filter 200, and a locking device 10 secures each tuning probe 100 to filter 200 at the desired depth. Of course any number of tuning probes, different installation depths, different probe diameters, etc. are also contemplated by the invention. Additionally, the tuning probe configuration and arrangement may vary greatly within the principles of the invention.

Filter 200 may also include several couplers 210, disposed in respective coupler ports along a second side. It should be noted, that the coupler ports are not necessary for the invention, the invention could be practiced without such. Additionally, if the coupler ports are included in the filter 200, they may be positioned differently and configured differently than is shown in the figures. Additionally, if couplers 210 are implemented in the filter 200, the couplers 210 may also be implemented with probes having a construction similar to probe 100 in that the depth can be varied in order to adjust the field and a locking device 10 may be used to lock the probe 100 in a desired position.

Figure 3:
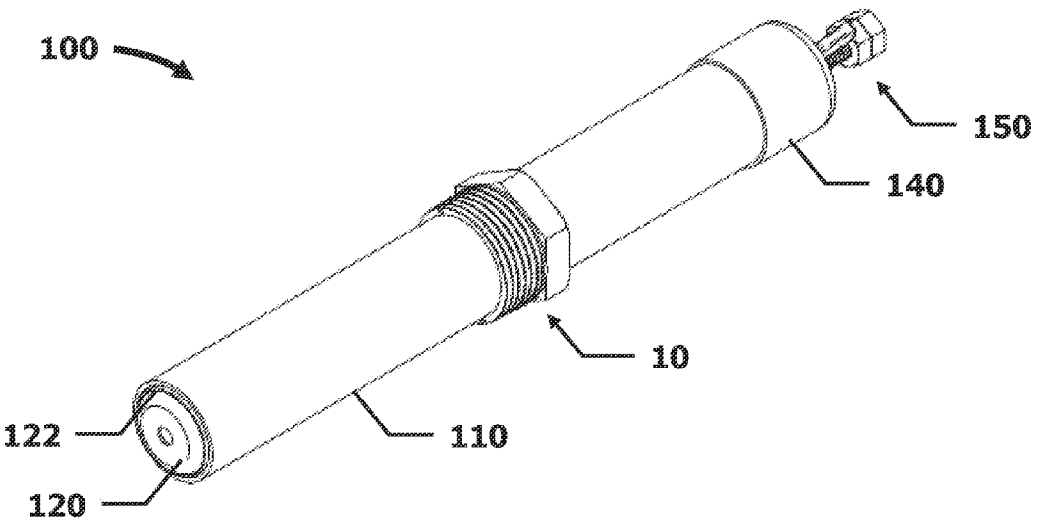
FIG. 3 is isometric view of a tuning probe constructed according to an embodiment of the invention.
Figure 4:
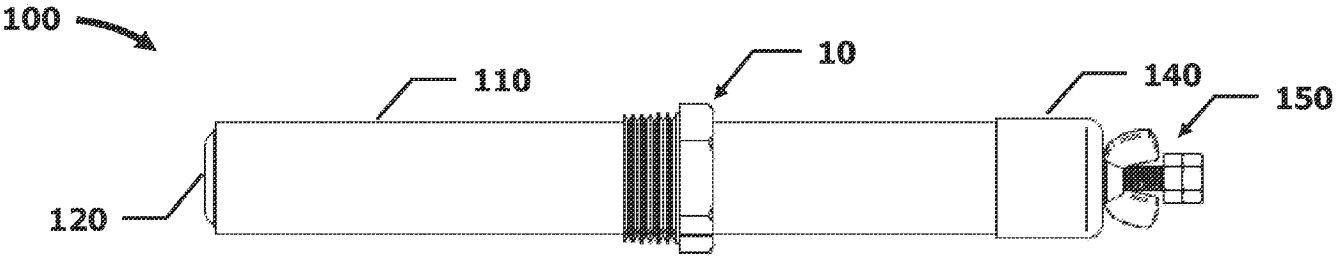
FIG. 4 is a side view of the tuning probe constructed according to FIG. 3.
Figure 5:
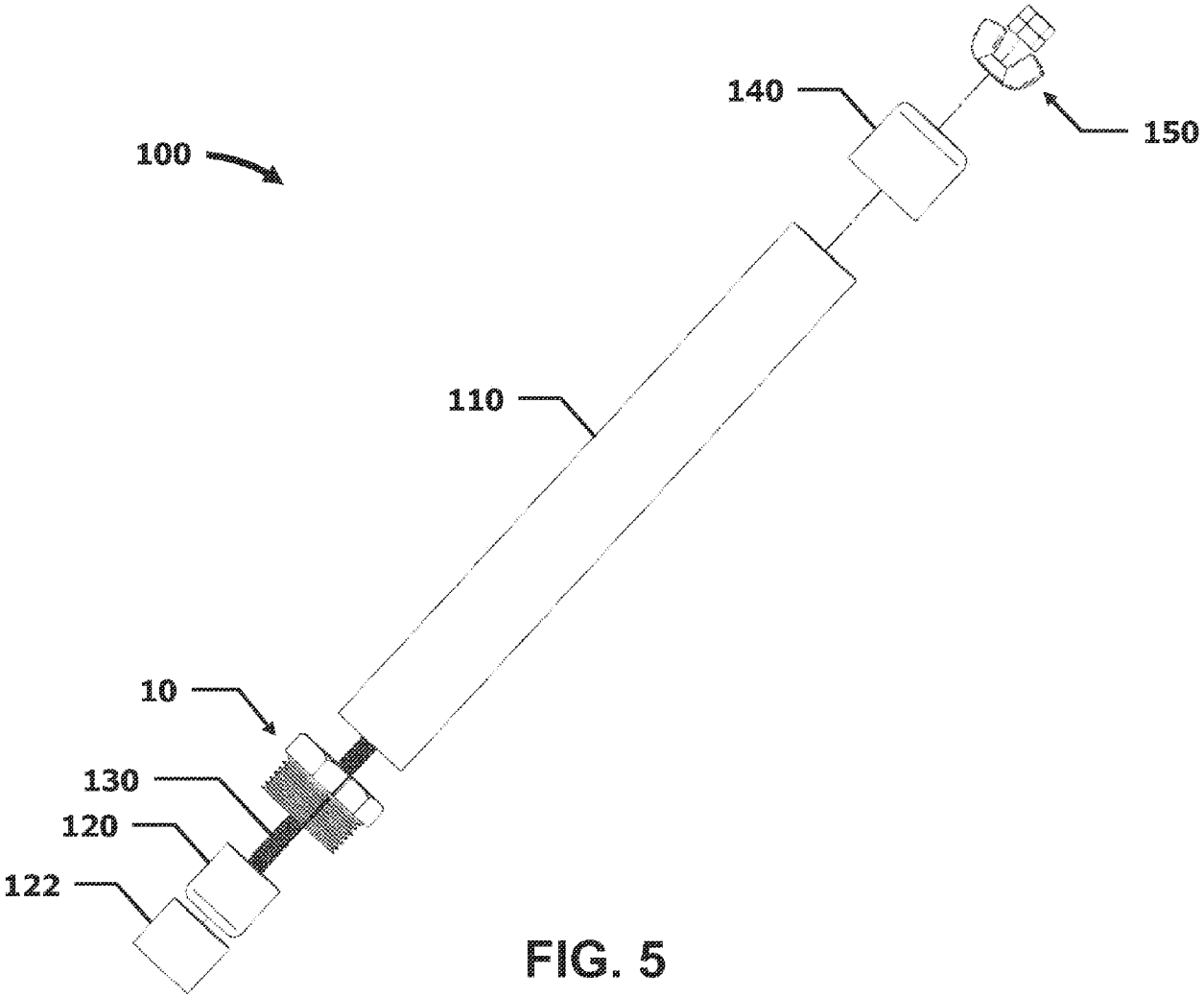
FIG. 5 is an exploded view of the tuning probe constructed according to FIG. 3.

FIG. 3 is isometric view of a tuning probe constructed according to an embodiment of the invention; FIG. 4 is a side view of the tuning probe constructed according to an embodiment of the invention; and FIG. 5 is an exploded view of the tuning probe constructed according to an embodiment of the invention. More specifically, FIGS. 3, 4 and 5 present an isometric view, a side view and an exploded view, respectively, of a tuning probe 100 according to an embodiment of the invention.

Tuning probe 100 may include a hollow cylindrical body 110 with openings at either end. However other geometric configurations are contemplated as well. The tuning probe 100 may further include an inner end cap 120 disposed within the lower end of body 110, a centering sleeve 122 disposed between the inner end cap 120 and the body 110, and an outer end cap 140 enclosing the upper end of body 110.

The tuning probe 100 may further include a mechanism to connect all the tuning probe 100 components together. In one aspect, a threaded rod 130 may be attached to the inner end cap 120 at one end and extend through a threaded opening of the outer end cap 140 at the other end. However, other types of configurations may be implemented to connect all the components. The tuning probe 100 may also include one or more mechanical fasteners 150, such as one or more nuts, wing nuts, etc., to secure the components of tuning probe 100 together. However, any type of structure that fastens the components of tuning probe 100 together is also contemplated by the invention including adhesives, welding, unitary construction, and the like.

Generally, body 110, inner end cap 120 and outer end cap 140 may be made from an electrically conductive material such as copper, which is used in a preferred embodiment. The sleeve 122 can be made from Polytetrafluoroethylene (PTFE) also known as Teflon®. The threaded rod 130 can be made from a metal or metal alloy having a low coefficient of thermal expansion, such as a nickel steel alloy, and the like. The outer end cap 140 may be attached to the upper end of the body 110 by soldering, etc., and the mechanical fastener 150 may be tightened against the outer end cap 140, which secures the threaded rod 130 in place. Additionally, in some implementations sleeve 122 may not be utilized. Furthermore, the end cap 120 may be modified for use in such an implementation. Implementations operating without the sleeve 122 may be based on different designs, different powers, and the like.

Locking device 10 is slidingly disposed on the outside of body 110 below the outer end cap 140, and, as noted above, secures tuning probe 100 to filter 200 at a desired penetration depth.

Figure 7:
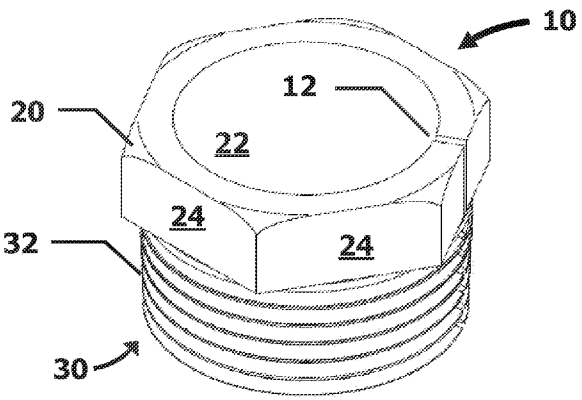
FIG. 7 is another isometric view of the locking device constructed according to FIG. 6.
Figure 6:
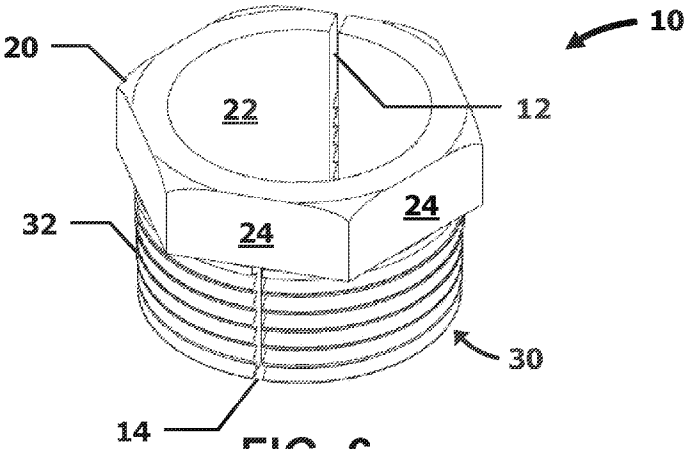
FIG. 6 is an isometric view of a locking device constructed according to an embodiment of the invention.
Figure 9:
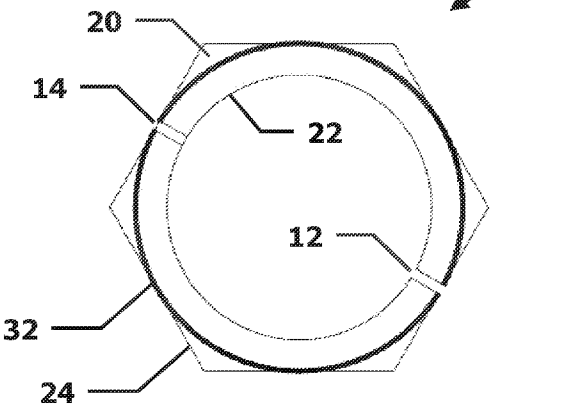
FIG. 9 is a bottom view the locking device constructed according to FIG. 6.
Figure 8:
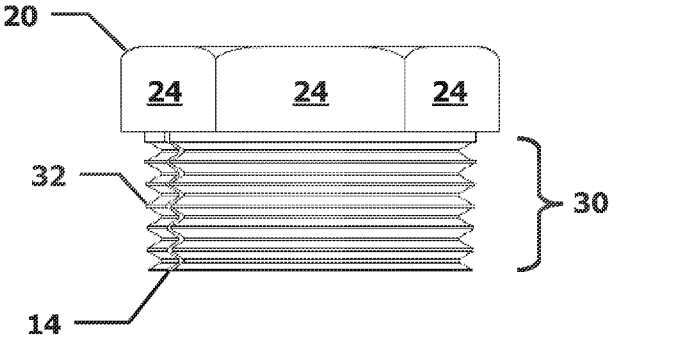
FIG. 8 is a side view of the locking device constructed according to FIG. 6.

FIG. 6 is an isometric view of a locking device constructed according to an embodiment of the invention; FIG. 7 is another isometric view of the locking device constructed according to an embodiment of the invention; FIG. 8 is a side view of the locking device constructed according to an embodiment of the invention; and FIG. 9 is a bottom view the locking device constructed according to an embodiment of the invention. In particular, FIGS. 6, 7, 8 and 9 present two isometric views, a side view and a bottom view, respectively, of a locking device 10 according to an embodiment of the invention.

The locking device 10 is configured to lock the tuning probe 100 with respect to the filter 200. It is contemplated that the locking device 10 can take any known form to limit movement of the tuning probe 100. In a particular aspect, the locking device may include a lock ring 20 and a lock body 30 that has an inner surface 22 whose diameter may be substantially the same as the outer diameter of tuning probe body 110.

In one embodiment, lock body 30 is formed from a short length of hollow copper tubing. The outer diameter of lock body 30 may include threads 32 that mate with matching threads in the filter tuning probe port. In one embodiment, lock ring 20 is a hexagonal nut with six faces 24, and is attached to the upper end of body 30 to provide mechanical purchase during installation of the tuning probe 100 into the filter tuning probe port. The filter tuning probe ports also may include corresponding threads that cooperate with the threads 32. In a particular implementation, the threads 32 may be configured as tapered threads. When utilized, the lock body 30 as it is rotated will cooperate with the threads 32 of the filter tuning probe port and will gradually move into the filter tuning probe port. As the lock body 30 moves into the filter tuning probe port, the inner diameter of the lock body 30 will gradually decrease due to the tapered nature of the threads 32 and accordingly lock the tuning probe 100 with respect to the filter tuning probe port, lock body 30, and the filter 200. Other lock ring 20 configurations are also contemplated, e.g., different numbers of faces, wing nut-type extensions, a circular circumference with a knurled edge, etc. A slot 12 may extend along lock body 30 and lock ring 20 to allow locking device 10 to expand when assembled to tuning probe 100. A slot 14 may extend along lock body 30, but not lock ring 20, to provide additional symmetrical compression of tuning probe 100 when the assembly is tightened into the filter tuning probe port. In a preferred embodiment, slot 14 is located about 180° from slot 12. However the angle between slot 14 and slot 12 can be any angle including 90°. Additionally, there may be multiple slots 12 and no slots 14; multiple slots 14 and no slots 12; a single slot 12; or a single slot 14. Other configurations are also contemplated.

Locking device 10 advantageously provides both mechanical stability and electrical contact between tuning probe 100 and the cavity wall of the filter tuning probe port. To adjust the penetration of tuning probe 100 into filter 200, locking device 10 is loosened until tuning probe 100 moves freely, the tuning probe can then be positioned at a desired position, and then locking device 10 is re-tightened to secure tuning probe 100 in a new position.

Figure 10:
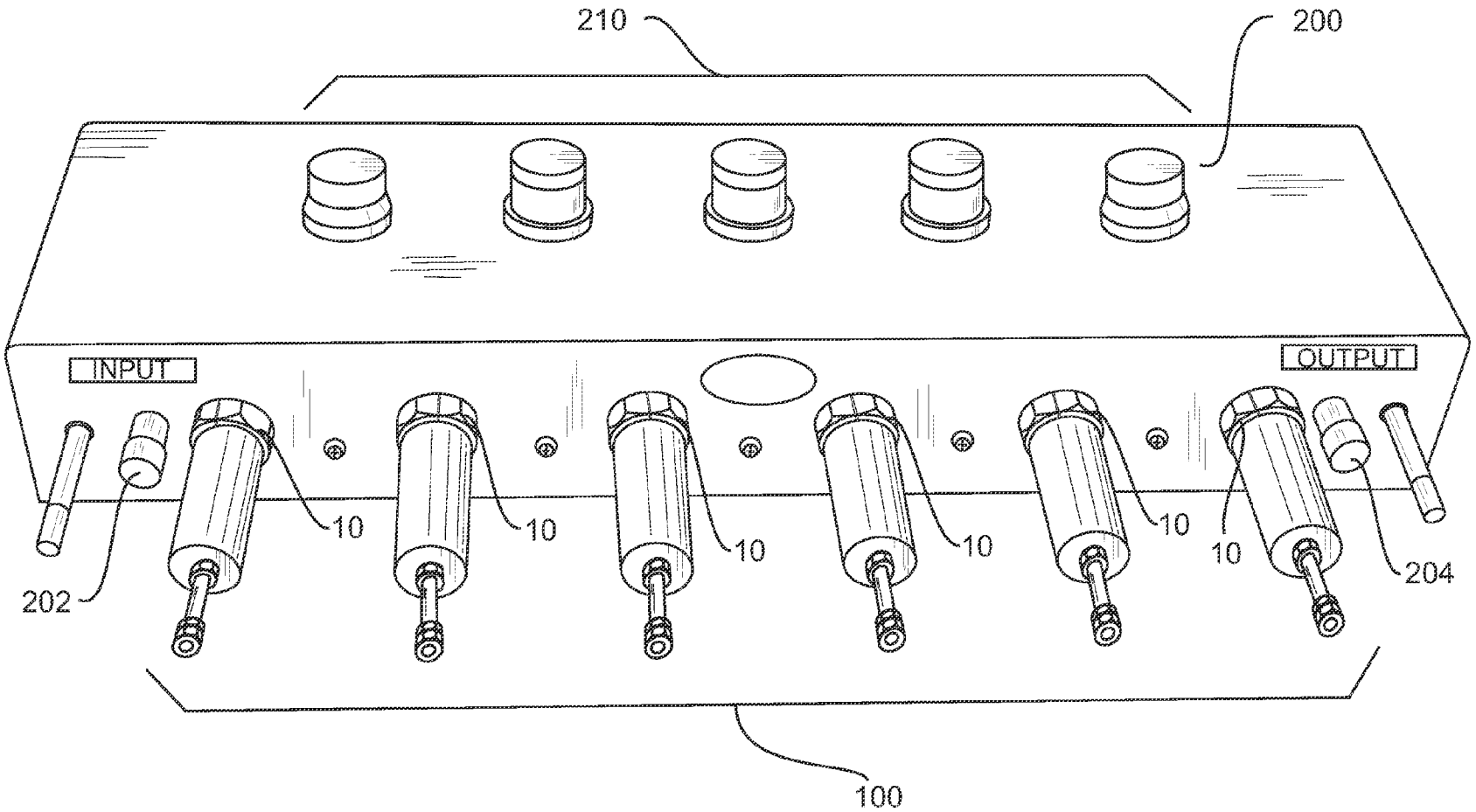
FIG. 10 is a similar radio frequency filter that has six tuning probes installed along one side constructed according to the invention.
Figure 11:
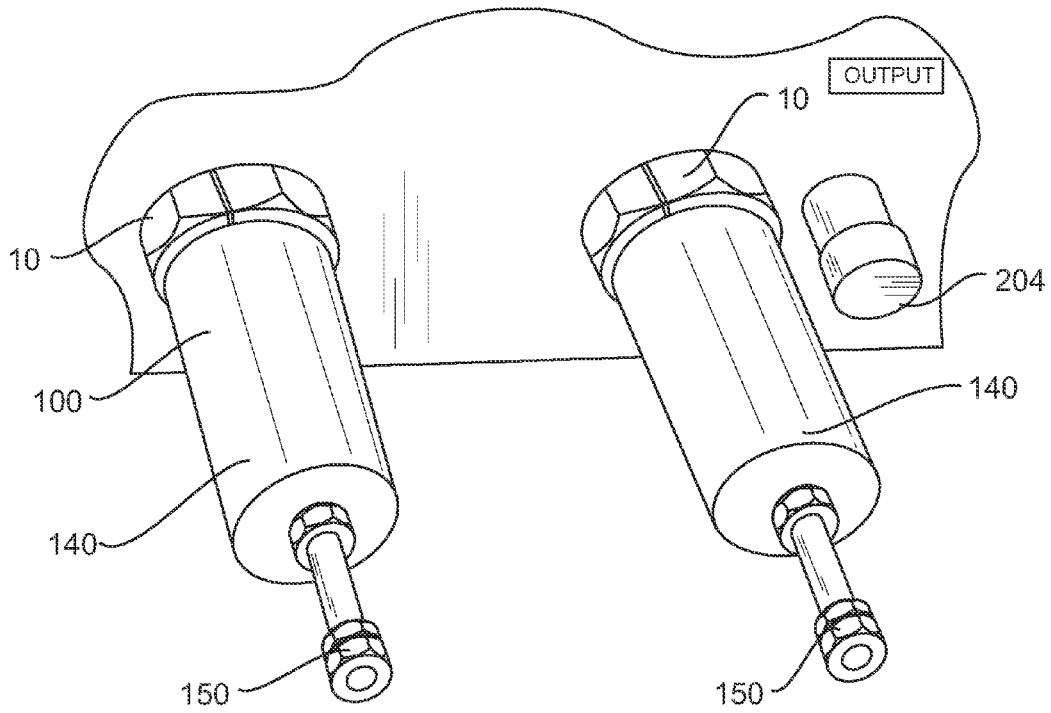
FIG. 11 is a close-up view of two tuning probes constructed according to FIG. 10.
Figure 12:
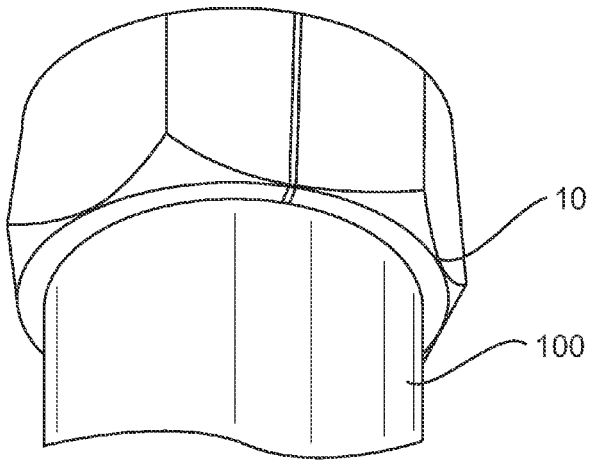
FIG. 12 is a close-up view of the tuning probe locking device constructed according to FIG. 10.

FIG. 10 is a similar radio frequency filter that has six tuning probes installed along one side constructed according to the invention; FIG. 11 is a close-up view of two tuning probes constructed according to the invention; and FIG. 12 is a close-up view of the tuning probe locking device constructed according to the invention. In particular, FIGS. 10, 11 and 12 show a similar RF filter that has six tuning probes installed along one side, a close-up of two tuning probes and a close-up view of a tuning probe locking device, respectively.

More specifically, FIG. 11 shows the locking device 10 arranged in the filter 200 holding the tuning probe 100 securely locked within the port of the filter 200. Additionally, FIG. 12 shows close-up details of the tuning probe 100 arranged in a port of the filter 200 and being locked in place by the locking device 10.

Additionally, it should be noted that the tuning probe 100 and the locking device 10 may be implemented in a number of different devices. The reference above to a radio frequency filter is merely exemplary. The tuning probe 100 and locking device 10 of the invention can be used in any type of RF device to modify the internal radio frequency fields. Implementations include coaxial lines, waveguides, variable RF transformers, devices having resonators, and any device needing to have adjustment of the field based on the depth of a component.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A radio frequency (RF) device comprising:

an input port configured to receive an input signal;

an output port configured to output an output signal;

a tuning probe configured to be movable within a tuning probe port to adjust filter characteristics;

the tuning probe port is configured to receive the tuning probe therein; and a locking mechanism configured to lock the tuning probe in the tuning probe port at a desired depth and further configured to prevent movement of the tuning probe in the tuning probe port when the locking mechanism is in a locked configuration, wherein the locking mechanism further includes a plurality of flat sides configured for engagement with a tool; and wherein the flat sides of the locking mechanism further comprise a slot configured to allow an inner diameter of the locking mechanism to increase to provide an unlocked configuration or decrease to provide the locked configuration.

2. The radio frequency (RF) device according to claim 1 wherein the locking mechanism comprises a threaded portion; and wherein the tuning probe port comprises a threaded portion that cooperates with the locking mechanism threaded portion to provide the locked configuration.

3. The radio frequency (RF) device according to claim 2 wherein the locking mechanism further comprises the slot in the threaded portion.

4. The radio frequency (RF) device according to claim 1 comprising at least one fixed coupler configured to be received in a filter coupler port.

5. The radio frequency (RF) device according to claim 1 wherein the tuning probe comprises a hollow cylindrical body.

6. The radio frequency (RF) device according to claim 1 wherein the tuning probe comprises an inner end cap, a centering sleeve, and an outer end cap.

7. The radio frequency (RF) device according to claim 6 further comprising a connector configured to connect the inner end cap, the centering sleeve, and the outer end cap.

8. A wireless communications system comprising a filter having the radio frequency (RF) device according to claim 1.

9. The radio frequency (RF) filter according to claim 1 wherein the tuning probe comprises an inner end cap, a centering sleeve, and an outer end cap.

10. The radio frequency (RF) filter according to claim 9 further comprising a connector configured to connect the inner end cap, the centering sleeve, and the outer end cap.

11. A radio frequency (RF) filter comprising:

an input port configured to receive an input signal;

an output port configured to output an output signal; a tuning probe configured to be movable within a tuning probe port to adjust filter characteristics;

the tuning probe port is configured to receive the tuning probe therein; and a locking means for locking the tuning probe in the tuning probe port at a desired depth and further configured to prevent movement of the tuning probe in the tuning probe port when the locking means is in a locked configuration, wherein the locking means further includes a plurality of flat sides configured for engagement with a tool; and wherein the flat sides of the locking means further comprise a slot configured to allow an inner diameter of the locking means to increase to provide an unlocked configuration or decrease to provide the locked configuration.

12. The radio frequency (RF) filter according to claim 11 wherein the locking means comprises a threaded portion; and wherein the tuning probe port comprises a threaded portion that cooperates with the locking mechanism threaded portion to provide the locked configuration.

13. The radio frequency (RF) filter according to claim 11 wherein the locking means further comprises the slot in the threaded portion.

14. The radio frequency (RF) filter according to claim 11 comprising at least one fixed coupler configured to be received in a filter coupler port.

15. The radio frequency (RF) filter according to claim 11 wherein the tuning probe comprises a hollow cylindrical body.

16. A wireless communications system comprising the radio frequency (RF) filter according to claim 11.

* * * * *